United States Patent [19]

Gregory

[11] Patent Number: 4,792,096

[45] Date of Patent: Dec. 20, 1988

[54] HOSE NOZZLE WITH HIGH PRESSURE PUMP

[76] Inventor: T. Jack Gregory, 1932 Weiss La., Penngrove, Calif. 94951

[21] Appl. No.: 132,367

[22] Filed: Dec. 14, 1987

[51] Int. Cl.[4] ..... B05B 15/02; B05B 9/04

[52] U.S. Cl. ..... 239/113; 239/438; 239/525; 417/525; 417/554

[58] Field of Search ..... 239/332, 112, 113, 438, 239/458, 525; 222/333, 133; 417/525, 554; 137/565

[56] References Cited

U.S. PATENT DOCUMENTS

| | | | |
|---|---|---|---|
| 1,722,960 | 7/1929 | Funston | 137/569 |
| 3,670,967 | 6/1972 | Fahlin et al. | 239/525 |
| 3,977,603 | 8/1976 | Magee, Jr. | 239/332 |
| 4,393,993 | 7/1983 | Kille et al. | 239/332 |

*Primary Examiner*—Andres Kashnikow
*Assistant Examiner*—Karen B. Merritt
*Attorney, Agent, or Firm*—Melvin R. Stidham

[57] ABSTRACT

A nozzle with self-contained high pressure booster pump is carried on a pistol grip handle with a small motor to drive the eccentrically-pump. A portion of the water from a conventional hose fitting flows laterally into a pump cylinder and then radially through the piston itself to exit axially through a check valve and into the pump chamber ahead of the piston. During the working stroke the water is driven out of the piston into a pressure chamber and then through a restricted passageway to exit in a jet stream. Another portion of the supply water is diverted around the pump cylinder to the same nozzle to flush away debris loosened by the jet stream.

8 Claims, 2 Drawing Sheets

HOSE NOZZLE WITH HIGH PRESSURE PUMP

BACKGROUND OF THE INVENTION

There are available a number of high pressure washers and sprays suitable for cleaning buildings, motor vehicles, driveways and the like. However, such systems usually include a fairly large motor and pump that are carried or wheeled to the site, but are not manipulated by the operator. The high pressure nozzle itself is mounted on the end of a relatively long hose from the new stationary pump from which a single, high pressure jet is projected. Such high pressure units are generally rather expensive and are not readily purchased by the typical homeowner or handyman.

OBJECTS OF THE INVENTION

It is an object of this invention to provide a hose nozzle that has a self-contained high pressure pump.

It is a further object of this invention to provide a hand-carried pump that can deliver a high pressure jet of water for loosening debris and a low pressure stream for flushing.

It is a further object of this invention to provide a hand-carried pump that can deliver a high pressure jet to loosen the debris from an article to be cleaned.

It is a further object of this invention to provide a high pressure pump and nozzle that is relatively inexpensive but efficient in operation.

It is a further object of this invention to provide a high pressure water washer or spray including a hand-carried pump wherein the pressure of the domestic water system is utilized to facilitate operation of the pump.

Further objects and advantages of this invention will become apparent from the description to follow, particularly when read in conjunction with the accompanying drawings.

SUMMARY OF THE INVENTION

In carrying out this invention, there is provided a hand-held nozzle that may be attached to an ordinary garden hose. A portion of the water stream flowing through the nozzle is diverted laterally through a reciprocating piston pump which is driven by an eccentric rotated by a small electric motor. The water enters the pump cylinder from the side and then flows into ducts that extend radially into the piston itself, to a central axial duct. From the axial duct in the piston, the water flows past a one-way check valve in the piston head and into the pump chamber ahead of the piston. On the working strokes of the piston, the water is forced out of the pump chamber and through a restricted passageway in the head of the cylinder to exit in the high pressure jet. In the meantime, the remainder of the supply water stream is diverted around the cylinder to also exit the nozzle in a low pressure stream to wash down and flush debris that is loosened by the high pressure jet. On the return stroke the piston is driven back primarily by the water pressure of the well or domestic system.

DESCRIPTION OF PREFERRED EMBODIMENTS

Figure 1:
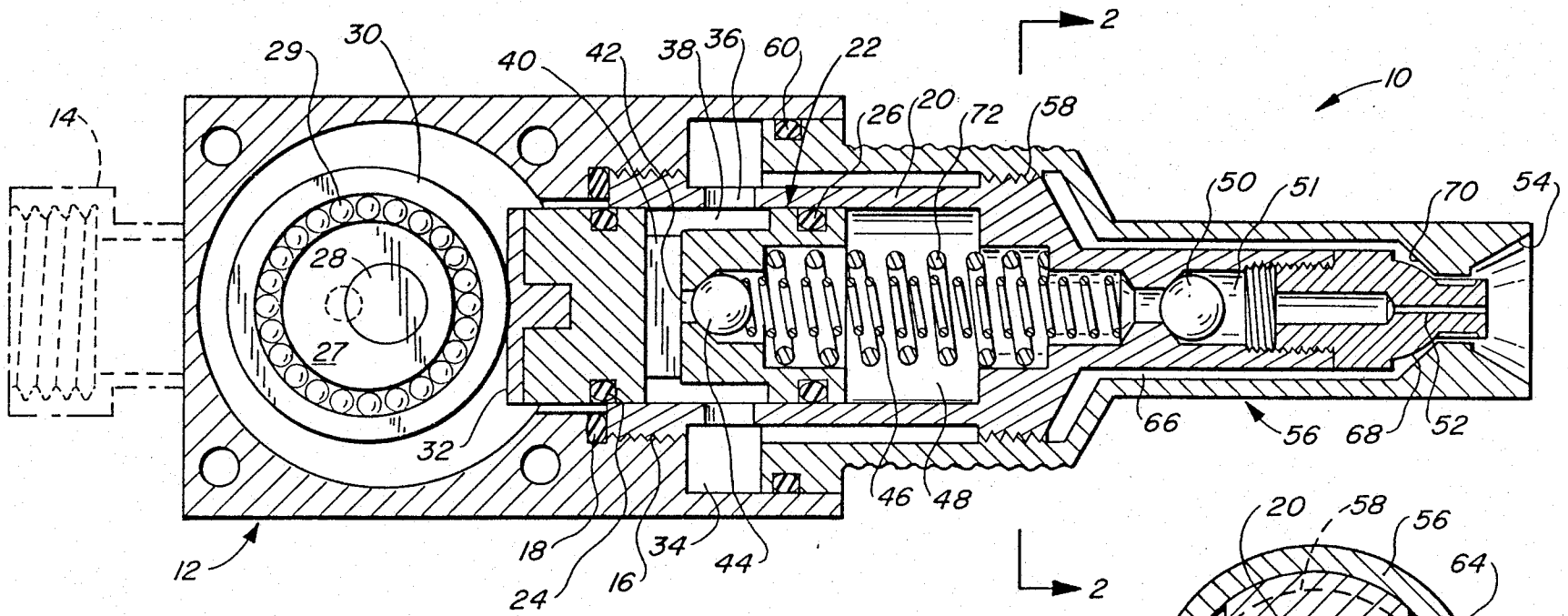
FIG. 1 is a horizontal section view of a high pressure nozzle with self-contained pump embodying features of this invention.
Figure 2:
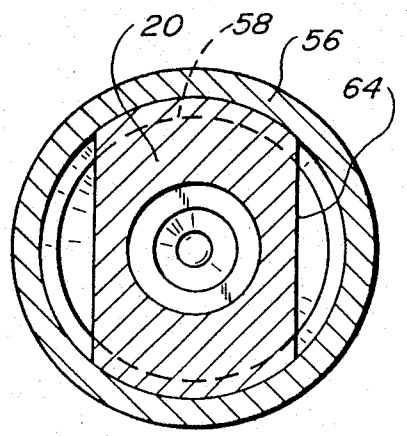
FIG. 2 is a section view taken along line 2—2 of FIG. 1.

The Embodiment Of FIGS. 1 and 2

In this embodiment of the invention 10 the nozzle body 12 carries a standard hose fitting 14 so that water can be supplied through a hose under normal system pressure of say 50–60 p.s.i. from a conventional domestic system or well pump. Threaded at 16 into the body 12 and sealed at 18 is the high pressure booster pump cylinder 20 in which a piston 22 is free to reciprocate.

The piston 22 is sealed at both ends, as by means of O-rings 24 and 26 and is driven in one direction (to the right in FIG. 1) by an eccentric 27 rotating on a shaft 28. The eccentric rotates in bearings 29 in an outer race 30, which engages the piston 22. A plate of hardened steel or the like 32 is provided on the trailing end of the piston in order to minimize wear.

A supply line pressure flow passageway 34 is formed in the body 12 to communicate with the inlet at the hose fitting 14, and the flow passageway 34 opens laterally into inlet ports 36 which are formed in the side of the pump cylinder 20.

The mid-section of the piston 22 is cut away at 38 to a reduced diameter to form an annular load chamber 38 around it to receive water from the flow passageway 34 and the inlet ports 36. Load ducts 40 extend radially into the piston to communicate with a central axial load port 42 in which is seated a one-way check valve 44. The load check valve is biased against the load port 42 by a compressor spring 46 to enable flow in one way only from the load duct 40 into the pump chamber 48 ahead of the piston 22.

As the piston 22 is driven by the eccentric 27 to the right from the position shown in FIG. 1 a charge of water, which has been drawn in the pump chamber 48 ahead of the piston 22, is driven by the piston 22 at an elevated pressure of say 300 to 400 p.s.i. axially past a ball check valve 50 and into a pressure chamber 51 at the same pressure. From the pressure chamber 51, the pressurized water is forced through a restricted passageway 52 to project in a jet stream from the nozzle opening 54.

The nozzle head 56 is threaded at 58 onto the cylindrical pump body 20 and is sealed within the main nozzle body 12, as by means of an O-ring 60. The annular space 62 between the nozzle head or body 56 and the cylinder pump body 20 is in communication with the line pressure flow passageway 34 so that a portion of the water stream is diverted to flow out the nozzle opening 54 and act as a flushing agent for particles of debris and the like which may be loosened by the high jet stream issuing from the restricted passageway 52.

To enable flow from the flush passageway 62 a portion of the threaded joint 58 is cut away at 64 (FIG. 2). The amount of water to flow through the flush passageway 62, 66 is controlled by a spherical valve 68, towards and against which a conical valve seat 70 moves as the nozzle body 56 is threaded at 58.

In operation, the nozzle 10 of this invention is attached to a conventional garden hose and water flows through the line pressure flow passageway 34 and through the annular duct 62, as well as into the inlet ducts 36, 38 and 40. When the piston 22 reaches the end of its working stroke to the right of the cylinder in FIG. 1, it is returned by supply line water pressure in the pump chamber 48. A spring 72 may be provided to ensure contact of the piston 22 with the outer race 30 of the eccentric at start up. Water flows into the void created by return of the piston 22 and intake flow is aided by the available pressure in the residential water system at 14. This available line pressure also aids in unseating the one-way check valve 44 and, as stated, in driving the piston 22 back to the left preparatory to the next working stroke driven by the eccentric 28.

The reduced diameter inlet annular chamber 38 around the piston 22 is of a length and so positioned so that it is always in communication with the pump inlet port 36 with piston seals 24 and 26 embracing the port 36 throughout the stroke of the piston 22.

Figure 3:
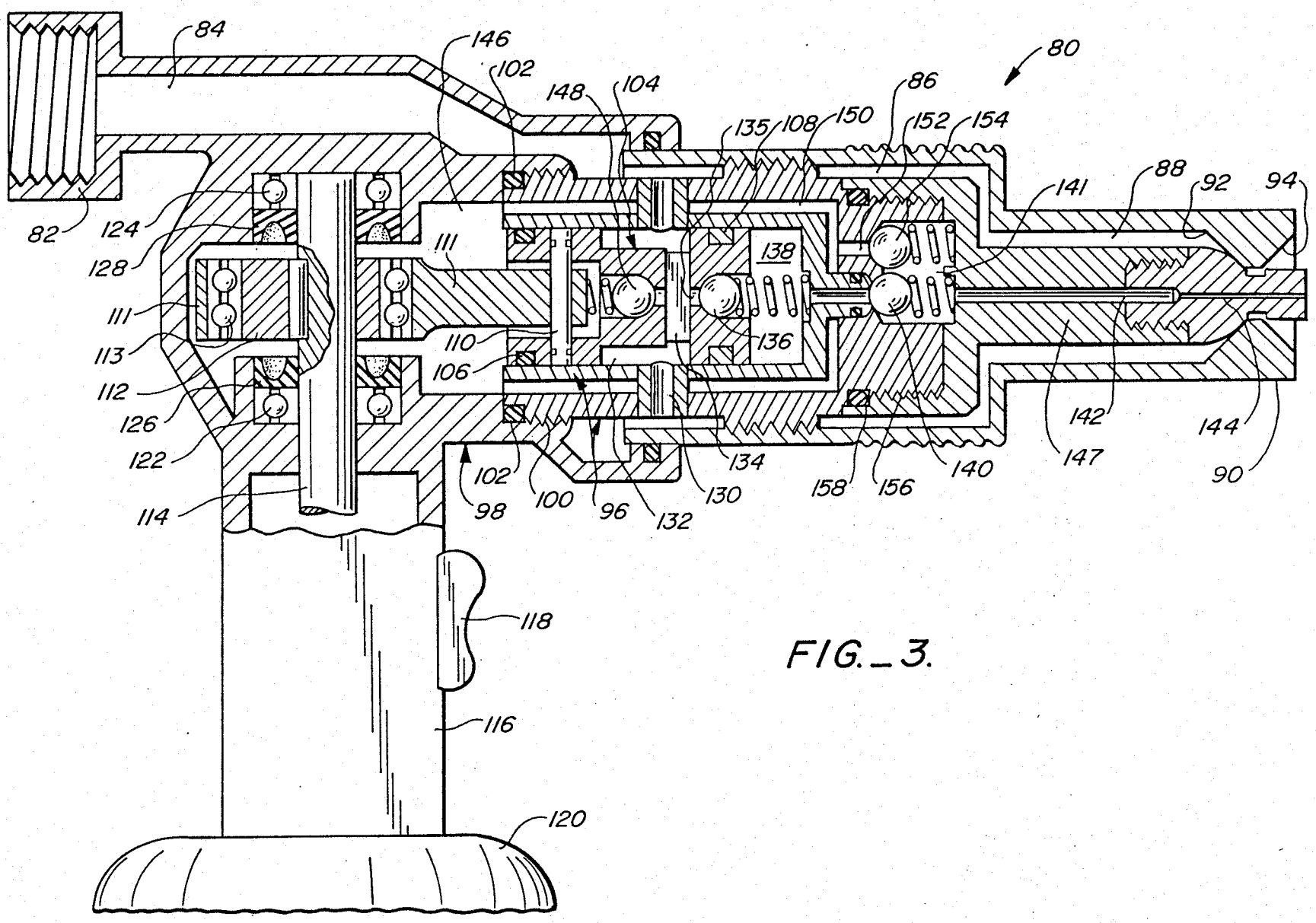
FIG. 3 is a vertical section view of another embodiment of this invention.

The Embodiment of FIG. 3

In this embodiment, the high pressure nozzle 80 has a hose fitting 82 through which water is delivered to a line pressure inlet passageway 84. As in the previous embodiment, a portion of the water stream may be diverted into a flush line 86, 88 around the high pressure pump 96 and, with the valve closure 90 retracted from the conical seat 92, the stream is projected out the nozzle opening 94.

A cylindrical pump body 96 is threaded into the nozzle body 98 at 100 and sealed at 102. A double acting piston 104 carrying suitable seals 106 and 108 is reciprocated in the cylinder 96 on a pin 110, which is carried on the outer race 111 of an eccentric 112 rotated on bearings 113 driven by a shaft 114.

The nozzle 80 is easily carried by means of a pistol grip handle 116, so that when the operator presses a suitable trigger switch 118 an electric motor 120 is energized to rotate the shaft 114 and, hence, the eccentric 112, reciprocating the piston 104 at a rapid rate. The motor shaft is carried in suitable bearings 122 and 123, which are sealed off by suitable seals 126 and 128.

As in the previous embodiment, a portion of the water stream is diverted through pump inlet ports 130 and into an inlet or load chamber 132, which is formed around the double acting piston 104. From the annular inlet chamber 132, the water flows into load ducts 134, which are directed radially into the piston 104 to a central duct 135, which is normally blocked by a check valve 136.

When the piston 104 moves to the left in FIG. 3, the water flows from passageway 84 and chamber 132 axially through the one-way check valve 136 into the right hand pump chamber 138, the unseating of check valve 136 being facilitated by the pressure differential created by the void as the pump moves to the left plus the normal water supply line pressure in the passageway 84.

When the piston reaches its leftward position shown in FIG. 3, the eccentric 112 drives it to the right forcing the water from the pump chamber 138 by a one-way outlet valve 140 and into a pressure chamber 141. From there, the water flows out through a restricted passageway 142, 144 to exit in a high pressure jet stream.

In the meantime, with the double acting piston 104 moving to the right, a void is created in the left-hand pump chamber 146 and water supply system line pressure in the passageway 84 easily overcomes the left-hand one-way ball check valve 148 to fill that chamber.

Formed in the cylindrical pump body 96 are a plurality of longitudinal passageways 150, around the cylinder 96. The passageways 150 open into a second outlet port 152, which is normally closed by a ball check valve 154. With the piston 104 moving to the left in FIG. 3, the water in the outlet longitudinal passageways 150 is pressurized to unseat the ball check valve 154 and flow into the pressure chamber 141, with the other ball check valve 140 being held firmly against its seat. As in the previous stroke, the water exits from the pressure chamber 141 through a restricted passageway 142, 144 in the nozzle body 146 which is threaded at 156 onto the pump body 96 and sealed at 158. The high pressure jet is projected out the nozzle opening 94.

While this invention has been described in conjunction with preferred embodiments thereof, it is obvious that modifications and changes therein may be made by those skilled in the art to which it pertains without departing from the spirit and scope of this invention, as defined by the claims appended hereto.

What is claimed as invention is:

1. A hose nozzle with a high pressure booster pump comprising:

a nozzle body;

means forming an internal pump cylinder in said body;

a supply line pressure flow passageway in said body radially outward of said pump cylinder;

an inlet port opening into said flow passageway;

a piston slidably mounted for reciprocation in said pump cylinder;

seals around said piston at opposite ends thereof;

a pump inlet duct communicating laterally between said line pressure flow passageway and said pump cylinder at a location therein intermediate and seals throughout reciprocation of said piston;

a load duct extending radially into said piston from the outer surface thereof intermediate said seals;

a load port in said piston communicating with said load duct and opening axially through the head of said piston;

a one-way check valve in said load port enabling flow in one direction only from said load duct through the head of said piston;

a nozzle outlet opening from said body;

a restricted high pressure duct extending generally axially through said body from the head of said cylinder to said nozzle outlet; and means for reciprocating said piston.

2. The hose nozzle defined by claim 1 including:

a flush line passageway in said body communicating directly between said supply line pressure flow passageway and said nozzle outlet.

3. The hose nozzle defined by claim 2 including:

valve means for controlling flow capacity of said flush line.

4. The hose nozzle defined by claim 1 wherein:

said one-way check valve is conditioned to be overcome by line pressure in said supply line pressure flow passageway to facilitate return of said piston.

5. The hose nozzle defined by claim 1 wherein:

said means for reciprocating said piston comprises:

eccentric means for driving said piston toward said head of the cylinder;

said one-way check valve being conditioned to be overcome by line pressure in said line pressure flow passageway so the line pressure in said cylinder forces return of said piston.

6. The hose nozzle defined by claim 1 wherein:

said means for reciprocating said piston comprises:

eccentric means for driving said piston toward said head of the cylinder; and line pressure in said cylinder for biasing said piston away from said head of the cylinder.

7. The hose nozzle defined by claim 1 wherein:

said line pressure flow passageway comprises an annular space in said body surrounding said internal cylinder.

8. The hose nozzle defined by claim 1 including:

a high pressure chamber between said pump cylinder and said restricted high pressure duct;

a first outlet duct opening from one end of said pump cylinder to said high pressure chamber;

a first outlet check valve in said first outlet duct enabling flow only into said high pressure chamber;

a second outlet duct between the other end of said pump cylinder and said high pressure chamber; and a second outlet check valve in said second outlet duct enabling flow only into said high pressure chamber;

said restricted high pressure duct opening from said high pressure chamber.

* * * * *